313-422
1/17/78 XR 4,069,436

United States Patent [19]

Nakayama et al.

[11] 4,069,436

[45] Jan. 17, 1978

[54] FLAT THERMIONIC CATHODE

[75] Inventors: Akira Nakayama, Fuchu; Akio Ohkoshi, Tokyo; Shoichi Muramoto, Tokyo; Takehisa Natori, Tokyo; Koichiro Sumi, Inagi; Hideaki Nakagawa, Ebina; Torao Aozuka, Chofu, all of Japan

[73] Assignee: Sony Corporation, Tokyo, Japan

[21] Appl. No.: 693,905

[22] Filed: June 8, 1976

[30] Foreign Application Priority Data

June 11, 1975 Japan ..... 50-70653

[51] Int. Cl.[2] ..... H01J 1/46; H01J 21/10

[52] U.S. Cl. ..... 313/302; 313/309; 313/337; 313/409; 313/422

[58] Field of Search ..... 313/305, 309, 302, 337, 313/340, 250, 338, 409, 422

[56] References Cited

U.S. PATENT DOCUMENTS

| | | | |
|---|---|---|---|
| 2,883,576 | 4/1959 | Harries | 313/340 X |
| 3,066,236 | 11/1962 | Sandbank | 313/250 |
| 3,463,978 | 8/1969 | Varadi | 313/250 |
| 3,528,156 | 9/1970 | Kling | 313/337 |
| 3,906,276 | 9/1975 | Barraco et al. | 313/337 |
| 3,978,364 | 8/1976 | Dimeff et al. | 313/309 |

*Primary Examiner*—Saxfield Chatmon, Jr.
*Attorney, Agent, or Firm*—Lewis H. Eslinger; Alvin Sinderbrand

[57] ABSTRACT

A flat thermionic cathode is provided with a substrate having at least one main heating element thereon to produce at least one substantially localized area of heat and a sub-heating element to substantially define a heating area, the localized area being produced within the heating area. A cathode element including electron emissive material is disposed at the localized area. While the localized area tends to produce a temperature gradient directed from the localized area toward the perimeter of the substrate so as to create thermal stress in the substrate along the perimeter thereof, the sub-heating element reduces this temperature gradient and, consequently, the thermal stress.

12 Claims, 9 Drawing Figures

FLAT THERMIONIC CATHODE

BACKGROUND OF THE INVENTION

This invention relates to thermionic cathode structures and, in particular, to an improved flat thermionic cathode formed on a substrate wherein the danger of damage to the substrate caused by thermal stress therein is substantially diminished.

Thermionic cathode structures are used in various vacuum and gas tube devices. Although many of such devices have been replaced by the advent of semiconductor technology, nevertheless, thermionic cathode structures are used as a source of electrons in cathode ray tubes (CRT), electron beam storage tubes and other electron beam devices. A typical thermionic cathode structure used in such devices, and particularly the CRT, may be assembled into an electron gun assembly formed of various control and accelerating grids whereby emitted electrons are shaped into a beam to scan a target. In general, such a thermionic cathode structure includes a metal tube or sleeve provided with a metal end wall. The outer surface of this end wall, that is, the surface facing away from the interior of the sleeve, is provided with thermionic electron emitting material, such as a coating of such material, whereby electrons readily are emitted therefrom when the coating is heated to a suitable temperature. The requisite heat is produced by a filament positioned within the metal sleeve, the filament being supplied with a heating current so as to maintain the proper temperature whereby electron emission occurs from the electron emissive coating.

This type of thermionic cathode structure, especially when provided in a color cathode ray tube used in color television receivers, is relatively difficult to assemble, thus requiring a highly skilled technician. Consequently, such a thermionic cathode structure has resulted in higher manufacturing costs and lower productivity in the manufacture of CRT's. For example, the metal sleeve of the cathode structure generally is supported by a ceramic disc which, in turn, is disposed within a cup-shaped control grid, the ceramic disc and cathode structure being particularly positioned within the grid such that the electron emissive coating is spaced from the end wall of the grid by a predetermined distance.

Accordingly, to avoid the problems of manufacturing and assembling such prior art thermionic cathode structures, and thus reducing the overall cost of manufacture, a flat thermionic cathode has been proposed. This proposed cathode structure is formed with an insulating substrate upon which a layer of resistive current conducting material is provided so as to form the heating element for the cathode. A portion of this heating element is coated with a layer of insulating material, and a layer of electron emissive material then is deposited upon at least a portion of the insulating layer. Hence, the metal sleeve and heating filament within the sleeve, heretofore typical of prior art thermionic cathode structures, are avoided.

Preferably, this flat cathode structure should be made as thin as possible. Accordingly, the substrate should be very thin so as to reduce the power consumption of the cathode heater element and, also, to reduce the time required for the electron emissive material to be sufficiently heated so as to emit electrons. Unfortunately, if the substrate is made thinner, there is a strong possibility that it may fracture or be otherwise damaged because of local thermal stress therein. That is, if the cathode heater element is provided in a relatively localized area so as to localize the heat applied to the electron emissive coating, a temperature gradient will be produced between the localized heating area in the substrate and, for example, peripheral areas of the substrate which are much cooler. This temperature gradient creates thermal stress in the substrate of a type which may cause fracturing, especially at the perimeter of the substrate.

OBJECTS OF THE INVENTION

Therefore, it is an object of the present invention to provide an improved flat thermionic cathode which avoids the afore-noted problems and disadvantages.

Another object of this invention is to provide a flat thermionic cathode structure wherein the danger of fracturing or otherwise damaging constituent elements of that structure because of thermal stress is reduced.

An additional object of this invention is to provide a cathode structure which is relatively simple and inexpensive to manufacture and to assemble in, for example, a cathode ray tube.

A further object of the present invention is to provide an improved cathode structure which can be heated rapidly to its operating temperature so as to provide a minimum delay between the time that the cathode is energized and the time that electrons are emitted therefrom.

Various other objects, advantages and features of the present invention will become readily apparent from the ensuing detailed discussion, and the novel features will be particularly pointed out in the appended claims.

SUMMARY OF THE INVENTION

In accordance with the present invention, an improved flat thermionic cathode structure is provided including a substrate, at least one main heating element provided on the substrate to produce at least one substantially localized area of heat, a sub-heating element provided on the substrate to substantially define a heating area, the localized area of heat being within the defined heating area; and a cathode element disposed at the localized area and including electron emissive material such that electrons are emitted therefrom when the localized area is heated to an operating temperature.

BRIEF DESCRIPTION OF THE DRAWINGS

The following detailed description, given by way of example, will best be understood in conjunction with the accompanying drawings in which.

DETAILED DESCRIPTION OF PREFERRED EMBODIMENTS

Figure 1:
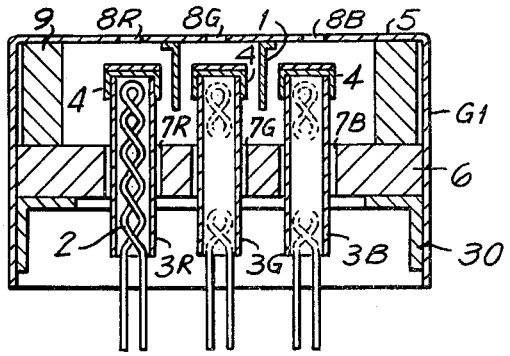
FIG. 1 PRIOR ART
FIG. 1 is a sectional plan view of a typical prior art cathode structure.

Before describing the improved flat thermionic cathode of the present invention, reference is made to FIG. 1 wherein a typical prior art cathode structure is shown. As one application thereof, the cathode structure may be used in a color cathode ray television picture tube of the type having separate red (R), green (G) and blue (B) cathodes. These red, green and blue cathodes are provided with corresponding metal sleeves 3R, 3G and 3B, each adapted to house a heater filament 2 therein and each having an end wall 4 formed of metal and coated with a layer of thermionic electron emissive material. The respective sleeves 3R, 3G and 3B fit within apertures 7R, 7G and 7B provided in a ceramic support disc 6, this structure being positioned within a cup-shaped control grid G1. The cup-shaped grid G1 is formed of a metal conductor having an end wall 5 provided with apertures 8R, 8G and 8B in alignment with the electron emissive coatings of the respective red, green and blue cathodes. In order to properly maintain the cathodes at a predetermined distance from the apertures 8R, 8G and 8B of grid G1, a spacer 9 is provided between the upper surface of support disc 6 and the inner surface of end wall 5 of grid G1. An annular retainer member 30, such as a lock washer, is fitted within the cup-shaped grid G1 so as to urge support disc 6 and spacer 9 against end wall 5. Hence, the cathode support structure is fixedly locked in place within grid G1 such that each of the electron emissive coatings of the respective red, green and blue cathodes is properly spaced a predetermined distance from apertures 8R, 8G and 8B in end wall 5.

Although not shown in FIG. 1, support tabs or pins are provided on disc 6 for accurately mounting respective sleeves 3R, 3G and 3B and, in addition, filaments 2 are welded to heater support members also positioned on disc 6.

Shield plate members 1, such as a cylindrical shield, separate or shield adjacent cathodes from each other so as to minimize crosstalk therebetween due to mutual interference. As shown, these shield plate members 1 may be secured to the inner surface of end wall 5 of grid G1 and depend from the end wall.

As may be appreciated from the structure illustrated in FIG. 1, the prior art cathode, when manufactured and assembled as part of a color cathode ray picture tube, requires a large number of parts for assembly, resulting in relatively low productivity and high manufacture costs. Also, full advantage cannot be taken of automated production techniques, thus requiring the use of highly skilled technicians.

Figure 2:
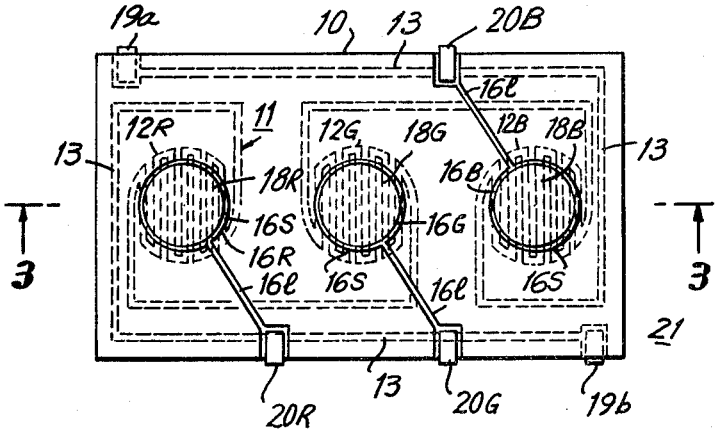
FIG. 2 is a top plan view of one embodiment of an indirectly heated flat thermionic cathode structure.

These disadvantages are overcome by the flat thermionic cathode structure of the type shown in the preferred embodiments of FIGS. 2–9. Referring to FIG. 2, which is a top plan view of one embodiment of a flat thermionic cathode, and FIG. 3, which is a sectional view taken along lines 3—3 of FIG. 2, it is seen that the flat thermionic cathode 21 is comprised of an insulating substrate 10 having heater element 11 thereon. The heater element is formed of a strip of resistive current conducting material, such as tungsten containing thorium and/or rhenium, capable of producing high operating temperatures when energized with a heating current. Heater element 11 may be formed by conventional deposition techniques or by other methods whereby the heater element is provided on insulating substrate 10.

Heater element 11 includes main heating elements 12R, 12G and 12B associated with the respective red, green and blue cathodes. Each main heating element 12 is formed of resistive current conductor 11 disposed in serpentine configuration and having a relatively high density so as to produce the necessary heat to activate the electron emissive material of each of the red, green and blue cathodes. Thus, each of main heating elements 12R, 12G and 12B produces a substantially localized area of heat.

Heater element 11 also includes a sub-heating element 13 formed of the resistive current conductor and disposed about the perimeter of substrate 10. When energized, sub-heating element 13 defines a heating area substantially within the perimeter of substrate 10. As is appreciated, the heat generated by this sub-heating element is less than the localized heat generated by the main heating elements 12R, 12G and 12B.

Figure 3:
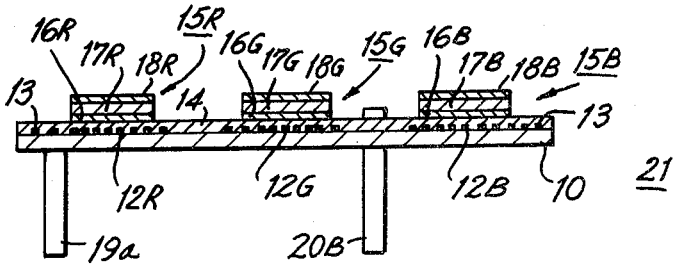
FIG. 3 is a sectional view taken along lines 3—3 of FIG. 2.

In the embodiment of FIGS. 2 and 3, the main heating elements 12R, 12G and 12B and the sub-heating element 13 all are connected in series. This series heating structure is connected between heating current supply terminals 19*a* and 19*b*. Typically, terminals 19*a* and 19*b* are connected to conducting posts which extend below substrate 10, as shown more clearly in FIG. 3. Accordingly, as viewed in FIG. 2, heating current supplied to, for example, terminal 19*b* flows through sub-heating element 13 near the lower edge of substrate 10 and then through sub-heating element 13 near the left edge of the substrate, through main heating element 12R, to main heating element 12G and then to main heating element 12B, thence through sub-heating element 13 near the right edge of substrate 10 and through sub-heating element 13 near the top edge of the substrate to terminal 19*a*. Thus, in the embodiment shown in FIGS. 2 and 3, sub-heating element 13 substantially circumscribes the localized areas whereat main heating elements 12R, 12G and 12B are disposed.

A layer of insulating material 14, such as a ceramic or aluminum oxide, is applied over substrate 10. Then, the respective red, green and blue cathodes 15R, 15G and 15B, respectively, are formed over each localized area defined by main heating elements 12R, 12G and 12B, respectively. The cathodes are substantially similar and, as an example, cathode 15R is comprised of a layer of conductive material 16R aligned with main heating element 12R, a metal layer 17R deposited over conductive layer 16R and a coating of electron emissive material 18R deposited upon metal 17R. The conductive layers 16R, 16G and 16B, respectively, include a circular-shaped portion 16S over the insulated main heating elements 12R, 12G and 12B, and conducting leads 16*l* to connect the respective conductive layers to terminals 20R, 20G and 20B provided along the perimeter of substrate 10. If desired, conductive layers 16R, 16G and 16B may be plated with nickel so as to improve the conductivity thereof.

Metal layers 17R, 17G and 17B can be deposited upon the respective conductive layers by applying a thin layer of nickel to which reducing agents, such as tungsten and magnesium, are added, and then soldering the deposited metal layer with gold. Alternatively, conventional evaporation techniques can be used to form metal layers 17R, 17G and 17B on conductive layers 16R, 16G and 16B, respectively. As yet another alternative, these metal layers may be formed by using conductive paint. As is recognized, other typical techniques can be relied upon for forming metal layers 17R, 17G and 17B on conductive layers 16R, 16G and 16B, respectively.

Electron emissive coatings 18R, 18G and 18B are formed on metal layers 17R, 17G and 17B, respectively, by painting or spraying a paste mixture of a single or multiple carbonate of barium, strontium and calcium, a binder, such as nitrocellulose, and a solvent, such as ethyl acetate. If desired, other electron emissive coatings may be used and formed on metal layers 17R, 17G and 17B, respectively, by other conventional techniques.

Terminals 20R, 20G and 20B, connected by conductors **16*l* to conductive layers 16R, 16G and 16B**, respectively, are adapted to be supplied with corresponding control voltages for controlling the respective red, green and blue cathodes.

In operation, heating current flowing through the respective main heating elements 12R, 12G and 12B produces localized areas of heat. If sub-heating element 13 is omitted for the moment, the localized heated areas produce a temperature gradient from the areas of maximum heat toward those portions of substrate 10 that are cooler. Hence, as viewed in FIG. 2, a temperature gradient is produced from the central portion of substrate 10, that is, from the localized heated areas defined by main heating elements 12R, 12G and 12B, outward toward the perimeter of the substrate. This temperature gradient in substrate 10 creates thermal stress which is analogous to a stretching or tensile stress. Although substrate 10 exhibits good characteristics with respect to constrictive stress, that is, the substrate is capable of withstanding relatively high constrictive stress, it cannot withstand comparable stretching or tensile stress. Thus, when flat cathode 21 is operated, the thermal stress produced in substrate 10 by the high heat generated by main heating elements 12R, 12G and 12B may result in fracturing or cracking the substrate, especially along the perimeter and edges thereof. This danger of damage to substrate 10 is avoided by providing sub-heating element 13 to circumscribe main heating elements 12R, 12G and 12B. The sub-heating element defines a heating area, as shown, which increases the temperature at the outer portions, or perimeter, of substrate 10. This, in turn, reduces the temperature gradient between the localized heated areas created by the main heating elements and the outer portions of the substrate. As this temperature gradient is reduced, the thermal stress in substrate 10 correspondingly is reduced. That is, when the perimeter of substrate 10 is heated, the thermal expansion of the central portion of the substrate relative to the outer portions thereof is reduced. This has the effect of producing constrictive stress to counter the stretching or tensile stress due to the localized heated areas. The effect of this constrictive stress is obtained normally of its direction. Hence, since the constrictive stress may be thought of as being applied from the perimeter of substrate 10 toward the central portion thereof, the effect of this constrictive stress is substantially along the circumference of the substrate. This counteracts the stretching or tensile stress due to the thermal stress in the substrate and, therefore, substantially reduces the possibility of fracturing or cracking the substrate along its edges.

Because of this reduction in the thermal stress in substrate 10, the substrate can be made relatively thin, such as on the order of 0.1 to 0.2 mm. in thickness, and the heating element 11 may be of the type capable of generating a great amount of heat. Hence, heating element 11 may be formed of tungsten. Thus, the reliability and operating longevity of the illustrated flat thermionic cathode are improved. Also, the heater power is increased and the time required for electron emission once the cathode heater is energized is reduced.

Figure 4:
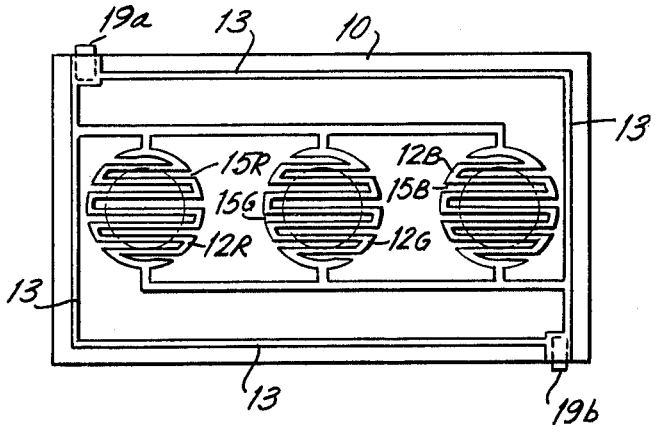
FIG. 4 is a top plan view of another embodiment of an indirectly heated flat thermionic cathode structure.

In the embodiment just described with respect to FIGS. 2 and 3, main heating elements 12R, 12G and 12B, and sub-heating element 13 all are connected in series. In one alternative embodiment, as shown in FIG. 4, the main heating elements and the sub-heating element all are connected in parallel. Nevertheless, because the main elements are disposed within the heating area defined by sub-heating element 13, the thermal stress in substrate 10 is reduced, as aforesaid. Therefore, the embodiment of FIG. 4, wherein sub-heating element 13 is provided along the perimeter of substrate 10, substantially reduces the danger of fracturing or cracking substrate 10.

Figure 5:
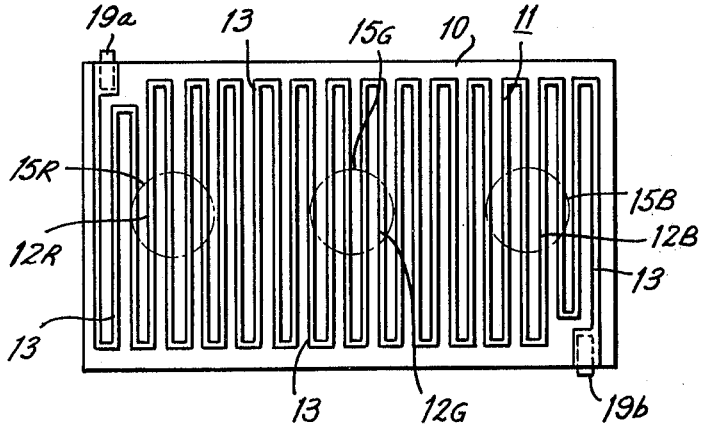
FIG. 5 is a top plan view of yet another embodiment of an indirectly heated flat thermionic cathode structure.

In the embodiment of a flat thermionic cathode, as shown in FIG. 5, the entire heater element 11 is uniformly provided in serpentine configuration over substantially all of substrate 10. This entire heater element 11 can be formed of the same resistive current conductor from one end portion to another. Of this heater element 11, three center portions may be regarded as main heating elements 12R, 12G and 12B, and the remainder may be regarded as the sub-heating element 13. This has the effect of increasing the heat in the heating area defined by the sub-heating element. That is, in addition to heating merely the perimeter or outer portion of substrate 10, as in the FIGS. 2 and 4 embodiments, sub-heating element 13 in FIG. 5 also heats the inner portions of the substrate. Because sub-heating element 13 is uniform across substrate 10, the temperature gradient from the localized areas is further reduced. However, since sub-heating element 13 of FIG. 5 generates more heat than is produced by the sub-heating element in the previously described embodiment, it is appreciated that greater heating power must be supplied to terminals **19*a* and 19*b*. That is, the heating current supplied to these terminals in FIG. 5 is greater than that supplied in the previously described embodiment. Also, even though portions 12R, 12G and 12B are regarded as main heating elements, they do not produce localized areas of heat separate and apart from sub-heating elements 13. Nevertheless, FIG. 5 is effective in reducing the danger of damage to substrate 10** caused by thermal stress therewithin.

Figure 6:
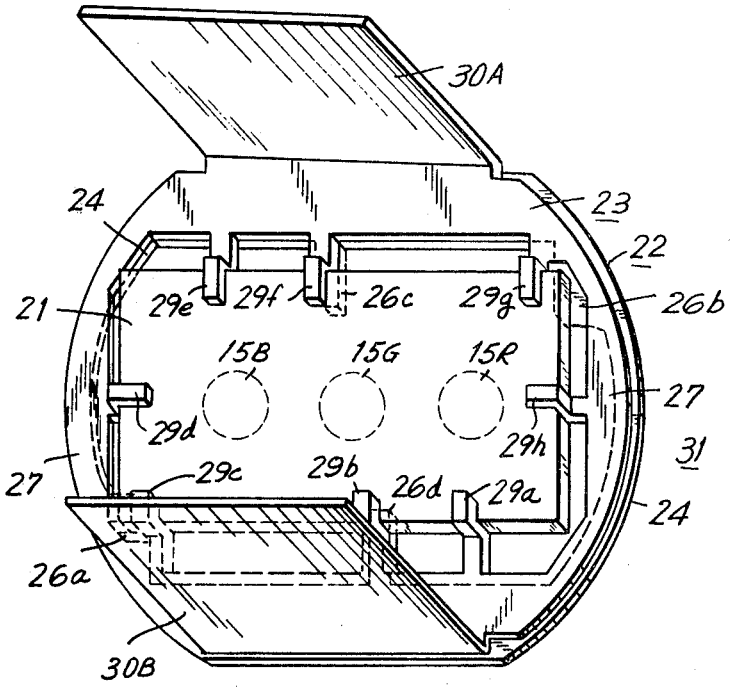
FIG. 6 is a perspective view of a cathode support structure for a flat thermionic cathode.
Figure 7:
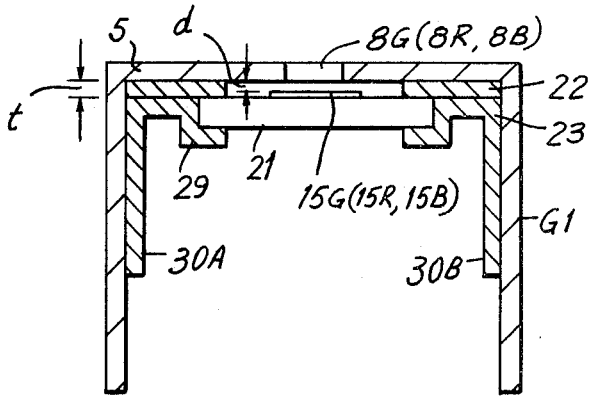
FIG. 7 is a sectional view of the cathode support structure of FIG. 6 in combination with a grid electrode.

One example of a support structure of the flat thermionic cathode described above now will be discussed with reference to FIGS. 6 and 7. Support structure 31 is comprised of a frame-shaped spacer 22 of predetermined thickness *t* having plural tab members **26*a*, 26*b*, 26*c* and 26*d* extending into the open area portion thereof and adapted to receive and support cathode structure 21. A frame-shaped locking member 23 is adapted to cooperate with spacer 22 and also includes tab members 29*a*, 29*b*, 29*c*, . . . 29*h* extending into the interior portion of locking member 23. Thus, tab members 26 and 29 on spacer 22 and locking member 23, respectively, function to grip cathode 21** along the perimeter of the cathode structure, and securely hold the cathode.

Frame 27 of locking member 23 also is provided with legs 30A and 30B which extend from frame 27, substantially as shown. Spacer 22 and locking member 23 are shaped, or contoured, so as to be inserted into a cup-shaped grid G1 as shown in FIG. 7. The outer surface of spacer 22 is adapted to contact the inner surface of end wall 5 of grid G1, and legs 30A and 30B extending from frame 27 of locking member 23 are adapted to be welded to the grid. Since spacer 22 is of predetermined thickness *t*, electron emissive coatings 18R, 18G and 18B of cathodes 15R, 15G and 15B, respectively, are spaced from wall 5 by the predetermined distance *d*. Hence, electrons emitted from these red, green and blue cathodes are seen to pass through apertures 8R, 8G and 8B, respectively, provided in end wall 5 of grid G1.

In assembling cathode 21 in its support structure 31, spacer 22 and locking member 23 are fixed together, such as by spot welding, once these respective members are suitably aligned. Preferably, tabs 29*a* . . . 29*h* provided on frame 27 of locking member 23 are not yet bent into the configuration shown in FIG. 6; rather, they extend outward of frame 27 so that cathode 21 can be properly positioned onto tabs 26*a* . . . 26*d* of spacer 22. Once cathode 21 is so inserted, tabs 29*a* . . . 29*h* are bent so as to grip and properly position cathode 21, as shown in FIG. 6. This aligns cathodes 15R, 15G and 15B so as to be suitably juxtaposed with respect to apertures 8R, 8G and 8B, respectively, of grid G1. Then, support structure 31, having cathode 21 suitably supported therein, is inserted into grid G1. As described above, the top surface of spacer 22 is urged into contact with the inner surface of end wall 5 of grid G1, and legs 30A and 30B extending from frame 27 are welded to the grid.

Since cathode 21 is supported by tabs 26*a*, . . . 26*d* and 29*a* . . . 29*h* in substantially point contact at the outer periphery of the cathode, the amount of heat transferred from cathode 21 to support structure 31 is reduced.

Figure 8:
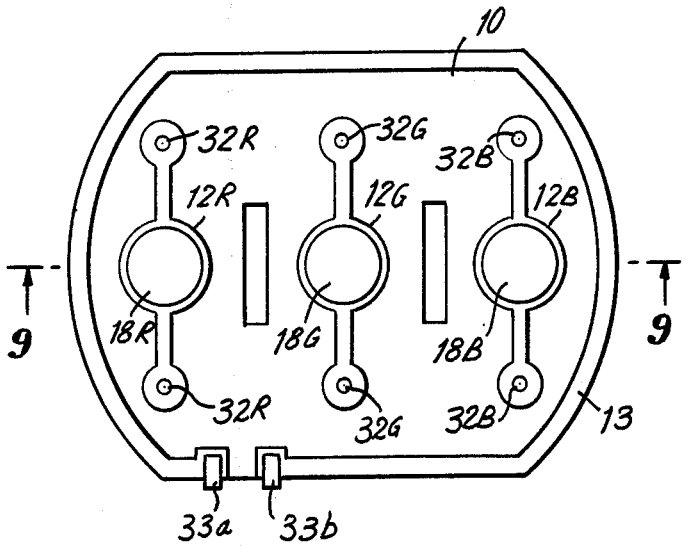
FIG. 8 is a top plan view of an embodiment of a directly heated flat thermionic cathode.
Figure 9:
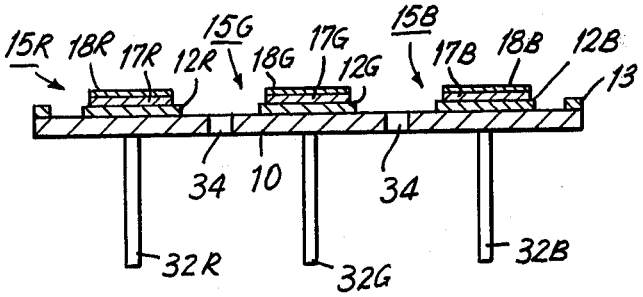
FIG. 9 is a sectional view taken along lines 9—9 of FIG. 8.

In the embodiments described hereinabove with reference to FIGS. 2, 4 and 5, it has been assumed that the cathode structures are of the indirectly heated type. Another embodiment of a flat thermionic cathode structure is shown in FIGS. 8 and 9 any may be considered to be of the directly heated type. That is, in the directly heated cathode, the insulating layer 14, previously shown as separating each of the cathodes from the heating elements, is omitted. As shown in FIGS. 8 and 9, main heating elements 12R, 12G and 12B are deposited at discrete areas on substrate 10. Metal layers 17R, 17G and 17B are deposited directly upon heating elements 12R, 12G and 12B, respectively, and, as before, electron emissive coatings 18R, 18G and 18B are applied to the respective metal layers. Sub-heating element 13 is provided substantially along the perimeter of substrate 10 so as to define a heating area, substantially in the manner and for the same purpose as described hereinabove.

Each main heating element 12R, 12G and 12B is electrically connected to heating current supply terminals, or pins, 32R, 32G and 32B, respectively. Sub-heating element 13 is electrically connected to heating current supply terminals 33*a* and 33*b*. Thus, as shown, the main heating elements and sub-heating elements are connected independently of each other. Nevertheless, sub-heating element 13 functions to reduce the thermal stress in substrate 10, thereby substantially reducing the possibility of damage to the substrate.

Apertures or slits 34 are provided in substrate 10 and are adapted to receive shielding members (not shown) to separate adjacent cathodes 15R, 15G and 15B so as to avoid crosstalk caused by mutual interference.

If desired, the independent connections of the respective main heating elements 12R, 12G and 12B and sub-heating element 13, shown in FIG. 8, may be replaced by the series connections, of the type discussed previously in respect to the embodiments of FIG. 2, or by a parallel connection, such as shown in FIG. 4. As yet another modification of the FIG. 8 embodiment, sub-heating element 13 may be uniformly provided across substrate 10 in a configuration shown, for example, in FIG. 5. Of course, the directly heated cathode structure of FIGS. 8 and 9 may be supported by cathode support structure 31 of the type shown in FIGS. 6 and 7.

While the present invention has been particularly shown and described with reference to certain preferred embodiments, it should be readily apparent that various changes and modifications in form and details may be made by one of ordinary skill in the art without departing from the spirit and scope of the invention. It is, therefore, intended that the appended claims by interpreted as including all such changes and modifications.

What is claimed is:

1. A flat thermionic cathode, comprising:

a substrate;

sub-heating means provided on said substrate responsive to an electric current flowing therethrough to substantially define a heating area;

main heating means provided on said substrate within said heating area responsive to an electric current flowing therethrough to produce at least one substantially localized area of heat; and cathode means disposed at said at least one localized area and including electron emissive material.

2. A flat thermionic cathode in accordance with claim 1 wherein said main heating means comprises plural main heating elements each formed of resistive current conductors arranged to produce a predetermined amount of heat to activate said electron emissive material; and said sub-heating means is arranged to reduce the temperature gradient produced by said main heating means.

3. A flat thermionic cathode in accordance with claim 2 wherein said sub-heating means comprises a resistive current conductor disposed in substantially circumscribing relation about said main heating elements.

4. A flat thermionic cathode in accordance with claim 3 wherein said main heating elements are connected in series and wherein said circumscribing resistive current conductor is connected in series with said main heating elements.

5. A flat thermionic cathode in accordance with claim 3 wherein said main heating elements are connected in parallel and wherein said circumscribing resistive current conductor is connected in parallel with said main heating elements.

6. A flat thermionic cathode in accordance with claim 3 wherein said substrate is of predetermined configuration and said circumscribing resistive current conductor substantially defines the perimeter of said substrate.

7. A flat thermionic cathode in accordance with claim 3 wherein said main heating elements are connected independently of each other and of said circumscribing resistive current conductor.

8. A flat thermionic cathode in accordance with claim 2 wherein the resistive current conductors of a main heating element are connected in series and arranged in serpentine configuration.

9. A flat thermionic cathode in accordance with claim 1 wherein said cathode means comprises a layer of insulating material overlying said main heating means; at least one metal element on said insulating layer disposed at said at least one localized area of heat; and a coating of electron emissive material on said at least one metal element.

10. A flat thermionic cathode in accordance with claim 1 wherein said cathode means comprises at least one metal element on said main heating means disposed at said at least one localized area of heat; and a coating of electron emissive material on said at least one metal element.

11. A flat thermionic cathode, comprising:

an insulating substrate;

plural heating elements disposed on said substrate, each including a resistive current conductor arranged in serpentine configuration to produce a corresponding localized area of heat, said localized areas of heat tending to produce a temperature gradient directed from localized areas toward the perimeter of said substrate, whereby thermal stress is created along said perimeter of said substrate;

sub-heating means disposed on said substrate and energizable to reduce said temperature gradient; and plural cathode members disposed at corresponding ones of said localized areas of heat, each cathode member including electron emissive material responsive to said heat.

12. A flat thermionic cathode structure adapted to cooperate with a grid member, comprising:

a substrate;

sub-heating means provided on said substrate to substantially define a heating area;

main heating means provided on said substrate within said heating area to produce at least one substantially localized area of heat;

cathode means disposed at said at least one localized area and including electron emissive material;

a frame-shaped spacer of predetermined thickness having plural tab members extending inward to said frame to support said substrate; and a frame-shaped locking means having plural tab members cooperable with the tab members of said spacer to grip said substrate therebetween, said spacer and said locking means being adapted for insertion into a cup-shaped grid whereby said cathode means are positioned at a predetermined distance from an end wall of said grid.

* * * * *